United States Patent [19]

Minemura et al.

[11] 3,953,167

[45] Apr. 27, 1976

[54] PROCESS FOR DYEING FIBERS OR FABRICS OF AROMATIC POLYAMIDES

[75] Inventors: Norihiro Minemura; Setsuo Yamada, both of Takatsuki, Japan

[73] Assignee: Teijin Ltd., Osaka, Japan

[22] Filed: July 16, 1974

[21] Appl. No.: 488,918

[30] Foreign Application Priority Data

July 24, 1973 Japan ..... 48-82676

[52] U.S. Cl. ..... 8/175; 8/93; 8/178 R

[51] Int. Cl.[2] ..... D06P 5/04

[58] Field of Search ..... 8/93, 178 R, 175

[56] References Cited

UNITED STATES PATENTS

| | | | |
|---|---|---|---|
| 3,506,990 | 4/1970 | Richardson et al. | 8/172 |
| 3,713,769 | 1/1973 | Beal et al. | 8/93 |
| 3,790,344 | 2/1974 | Frickenhaus et al. | 8/93 |
| 3,809,533 | 5/1974 | Sievenpiper | 8/93 |

FOREIGN PATENTS OR APPLICATIONS 856,381 12/1960 United Kingdom

OTHER PUBLICATIONS

Bulletin No. N-249 Published June 1971, DuPont Technical Information on Nomex Fibers.

*Primary Examiner*—V. P. Hoke

*Attorney, Agent, or Firm*—Sherman & Shalloway

[57] ABSTRACT

Aromatic polyamide fibers or fabrics are dyed in a deep and brilliant color with good light fastness by impregnating the fibers or fabrics with (*a*) a cationic dye, (*b*) an aliphatic hydroxy compound having a boiling point of at least 180°C., (*c*) at least one swelling agent selected from o-phenylphenol, p-phenylphenol, benzophenone, α-naphthol and β-naphthol and (*d*) at least one of alkali metal salts or ammonium salts of inorganic or organic acids, the amount of the salt being 1 to 10% by weight based on the sum total of the amounts of (*a*), (*b*), (*c*) and (*d*), and then heat-treating the fibers or fabrics with steam.

8 Claims, No Drawings

PROCESS FOR DYEING FIBERS OR FABRICS OF AROMATIC POLYAMIDES

This invention relates to a process for dyeing aromatic polyamide fibers or fabrics.

Aromatic polyamide fibers or fabrics have extremely superior flame retardancy and thermal stability, but because of extreme rigidity of the molecular chain, they cannot be easily dyed by conventional dyeing methods. This has been a serious drawback in developing the utility of these fibers or fabrics.

Attempts to overcome the dyeing difficulty of aromatic polyamide fibers or fabrics include, for example, a method comprising adding a swelling agent for the aromatic polyamide fibers or fabrics to a dye bath, and a method comprising pre-treating the fibers or fabrics with a swelling agent. However, according to the method involving adding the swelling agent to the dye bath, it is extremely difficult to disperse the swelling agent uniformly especially in the case of deep dyeing, owing to the use of a large quantity of the swelling agent or its water-insolubility. Consequently, tarring occurs easily, and non-uniformities of dyeing, such as specks, occur in the dyeings. The method of pretreating the fibers or fabrics with the swelling agent involves dispersing the swelling agent in the fibers prior to dyeing, and therefore, requires a separate step of treating fibers or fabrics at high pressures using an aqueous dispersion of the swelling agent. This method therefore has the defect that the time required for dyeing becomes longer.

Accordingly, an object of this invention is to provide a process for uniformly dyeing aromatic polyamide fibers or fabrics easily and with good efficiency by overcoming the difficulties of the conventional processes.

Another object of this invention is to provide a process for dyeing aromatic polyamide fibers or fabrics in deep colors and to a high level of fastness characteristics.

The above objects of this invention can be achieved by a process for dyeing aromatic polyamide fibers or fabrics in accordance with this invention, which comprises impregnating aromatic polyamide fibers or fabrics with (a) a cationic dye, (b) an aliphatic hydroxy compound having a boiling point of at least 180°C., (c) at least one swelling agent selected from the group consisting of o-phenylphenol, p-phenylphenol, benzophenone, $\alpha$-naphthol and $\beta$-naphthol and (d) at least one of alkali metal salts or ammonium salts of inorganic or organic acids, the amount of said salt (d) being 1 to 10% by weight based on the sum total of the amounts of the dye (a), the hydroxy compound (b), the swelling agent (c) and the salt (d); and then heat-treating said fibers or fabrics with steam.

The compounds (a), (b), (c) and (d) can be impregnated by various methods, but the following two methods are especially recommended.

1. A method which comprises dissolving or dispersing the dye, swelling agent and salt in the aliphatic hydroxy compound, and impregnating the fibers or fabrics with the resulting solution or dispersion.

2. A method which comprises impregnating the fibers or fabrics with an aqueous solution containing the dye, drying the fibers or fabrics, and then impregnating the fibers or fabrics with a solution or dispersion of the swelling agent and the salt in the aliphatic hydroxy compound.

Any of the above impregnating methods can be easily performed by a pad steam method which has been commercially established, and this can result in the shortening of the dyeing time. For example, the dyeing time can be shortened to less than one-third of that required in the conventional process comprising pretreating aromatic polyamide fibers or fabrics with an aqueous solution of swelling agent at high pressures.

The aromatic polyamide fibers or fabrics that can be used in the present invention are those prepared, for example, from the following polyamides.

1. Polyamides prepared by condensing dicarboxylic acids having an aromatic ring with diamines having an aromatic ring or a substituted aromatic ring:

Examples of the dicarboxylic acid are terephthalic acid or isophthalic acid, and examples of the diamine are metaphenylene diamine, sodium-2,4-(or 3,5) diaminobenzenesulfonate, 1-chloro-2,4-(or 3,5) diaminobenzene and 1-methyl-2,4-(or 3,5)diaminobenzene. These polyamides may be not only homopolymers derived from one kind of dicarboxylic acid and one kind of diamine, but also copolymers derived from at least one dicarboxylic acid and at least one diamine. Examples are poly(metaxylylene terephthalamide), or a copolyamide derived from metaphenylene diamine and isophthalic acid and terephthalic acid.

2. Polyamides obtained by condensing aminocarboxylic acids having an aromatic ring or substituted aromatic ring:

Examples of the aminocarboxylic acids are p-aminobenzoic acid and sodium-2-amino-5-carboxybenzenesulfonate. These polyamides include not only homopolymers from one kind of aminocarboxylic acid, but also copolymers derived from at least two kinds of aminocarboxylic acids. One example of the former is a polycondensate of p-aminobenzoic acid, and an example of the latter is a copolymer derived from para-aminobenzoic acid and meta-aminobenzoic acid.

3. Polyamides obtained by copolymerizing the monomers mentioned in (1) and (2) above:

A typical example is a polyamide obtained by polycondensing meta-phenylene diamine, isophthalic acid and para-aminobenzoic acid.

4. Copolyamides obtained by polycondensing in solution an aromatic dicarboxylic acid dichloride, an aromatic diamine and a sulfur-containing monomer of the following formula $$\begin{array}{l} Cl-CO-Z-CO-Cl \\ \quad\quad\quad\;\; | \\ \quad\quad\quad (OCH_2CH_2CH_2)n-SO_2Cl \end{array}$$

wherein Z is benzene, naphthalene or diphenyl, and $n$ is o or 1, and treating the resulting polymer with a basic inorganic compound of an element of Groups 1 or 2 of the periodic table:

An example of such a copolyamide is an aromatic polyamide obtained by treating a polymeric solution prepared from m-phenylene diamine, isophthaloyl chloride and 5-chlorosulfonyl isophthaloyl chloride (5 mol%) with calcium hydroxyde.

The swelling agent used in this invention is selected from ortho-phenyl phenol, para-phenyl phenol, benzophenone, $\alpha$-naphthol and $\beta$-naphthol. The amount of the swelling agent to be used differs according to the type of the fibers and dyes and the dyeing method. Preferably, the amount is 5 to 50% by weight, more preferably 5 to 15% by weight, based on the total amount of the dye, swelling agent, salt and aliphatic hydroxy compound.

The aliphatic hydroxy compound used in this invention should be a non-evaporable liquid which has the ability to dissolve or disperse the dye and the swelling agent and has a boiling point of at least 180°C. and does not adversely affect fibrous materials. This compound constitutes a substantially inert high temperature heating medium which causes the dye to be fixed in the fibers or at least to make it easy for the dye to permeate into the fibers. Examples of suitable liquid having these characteristics are ethylene glycol, propylene glycol, methyl cellosolve, diethylene glycol, methyl carbitol, glycerine, butyl cellosolve, triethylene glycol, and polyoxyethylene glycol. These compounds are used either alone or in admixture with each other. Ethylene glycol and propylene glcyol are especially preferred. Water or a polar solvent such as methanol, ethanol, acetone and dimethyl formamide may be used conjointly with the non-evaporable liquid aliphatic hydroxy compound in order to increase its solubilizing power for the dye and the swelling agent. The suitable amount of water or the polar solvent is not more than 25% by weight of the sum total of the amounts of the dye, swelling agent, salt and non-evaporable aliphatic hydroxy compound. The most suitable dyes for dyeing the aromatic polyamide fibers or fabrics in accordance with the process of this invention are cationic dyes. Examples of suitable cationic dyes are Astrazon Yellow 7GLL (C. I. Basic Yellow 21), Basacryl Yellow 5RL (C. I. Basic Yellow 25), Sumiacryl Orange R (C. I. No. 48,040, C. I. Basic Orange 22), Basacryl Red GL (C. I. Basic Red 29), Astrazon Olive Green BL (C. I. Basic Green 6), Diacryl Orange RL-E (C. I. Basic Orange 32), Astrazon Red BBL (C. I. Basic Red 23), Aizen Cathilon Red GLH (C. I. Basic Red 38), Astrazon Blue GL (C. I. Basic Blue 54) and Sumiacryl Blue E-6G (C. I. Basic Blue 3).

The suitable amount of the dye is 2 to 20% by weight of the sum total of the amounts of the dye, swelling agent, salt and non-evaporable aliphatic hydroxy compound.

In order to facilitate the diffusion of the cationic dye in the fibers, the salts are added to the non-evaporable liquid aliphatic hydroxy compounds.

Examples of the salts are alkali metal salts or ammonium salts of inorganic or oganic acids. These are used either alone or in admixture with each other.

Examples of the salts include alkali metal salts and ammonium salts of hydrogen chloride, hydrogen bromide, nitric acid, sulfuric acid, pyrosulfuric acid, phosphoric acid, pyrophosphoric acid, thiocyanic acid, formic acid, acetic acid, benzoic acid, benzensulfonic acid, and alkylbenzenesulfonic acids. In order to prevent the decomposition of the dye in the steam treatment, it is also possible to incorporate an organic acid in the non-evaporable aliphatic hydroxy compound.

Preferred organic acids include, for example, acetic acid and formic acid.

The above salts are used in an amount of 1 to 10% by weight, preferably 3 to 10% by weight, based on the sum total of the amounts of the dye, swelling agent, non-evaporable aliphatic hydroxy compound and salts. Larger amounts of the salts generally give rise to better dyeability, but from the viewpoint of solubility, they are used in amounts of up to 10% by weight, preferably up to 8% by weight, based on the sum total of the amounts of the dye, swelling agent, non-evaporable liquid aliphatic hydroxy compound and salts.

It has been found that in order to dye aromatic polyamide fibers or fabrics with cationic dyes to give dyeings of deep color and superior light fastness, the use of great quantities of salts within the above ranges is required.

Where the above organic acid is used, its suitable amount is 1 to 10% by weight based on the sum total of the amounts of the dye, swelling agent, salts and non-evaporable aliphatic hydroxy compounds.

Impregnation of the aromatic fibers or fabrics with the non-evaporable liquid aliphatic hydroxy compound containing the dye, swelling agent and salts is acocomplished, for example, by a method which comprises introducing the fibers or fabrics continuously into the hydroxy compound, and squeezing them uniformly to remove the excessive liquid, or a method which comprises impregnating the fibers or fabrics in the liquid while winding them up using a jigger dyeing machine. Examples of the method of heat-treatment in steam include a method involving heat-treatment in saturated steam continuously or discontinuously, a method involving heat-treatment in superheated steam, or a method which involves treatment with heated steam while passing the fibers or fabrics back and forth using a jigger at a high pressure. These methods per se are known in the art of dyeing.

The treating temperature is suitably 100° to 270°C., and the suitable treating time is 1 to 120 minutes. Preferred temperature and time conditions are 120° to 140°C. and 10 to 90 minutes for treatment with saturated steam, and 180° to 280°C. and 1 to 30 minutes for treatment with superheated steam. The former is especially preferred.

When the fibers or fabrics are impregnated first with an aqueous solution of the dye, they are introduced continuously into the aqueous solution of the dye, and then the excessive dye solution is removed by squeezing with a mangle to impregnate the solution uniformly in the fibers or fabrics. Then, the dyed fibers or fabrics are dried at a temperature of 90° to 150°C. until substantially free of water.

Preferably, the aqueous dye solution has a concentration of 2 to 20% by weight.

After the above procedure, the non-evaporable liquid aliphatic hydroxy compound containing the swelling agent and the salts is impregnated in the fibers or fabrics in which the dye has been impregnated in the above-described manner. This can be performed in the same way as in the case of impregnating the fibers or fabrics simultaneously with the dye, swelling agent, salt and non-evaporable liquid aliphatic hydroxy compound.

The steam treatment can also be performed in the same manner.

After dyeing, the dyed fibers or fabrics are soaped in a customary manner to remove the unfixed dye or dyeing assistants to complete the dyeing step.

Since the non-evaporable liquid aliphatic hydroxy compound is very viscous as compared with water, the dye or swelling agent can be dispersed uniformly therein even if not dissolved, and therefore, the tarring of the dye and the swelling agent ascribable to the non-uniform dispersion inherent to the conventional method using an aqueous system does not occur, and therefore, no unevenness in dyeing occurs.

Furthermore, according to the present invention, the efficiency of utilizing the dye is very good as compared with the conventional methods. In the conventional methods, the rate of using the dye is about 60% at most, whereas in the present invention, it shows a marked increase to 70 to 75%. Although the mechanism of this is not clear, the fact is that the high rate of utilizing the dye in accordance with the present invention cannot be obtained unless fibers of fabrics are heat-treated with steam after impregnating them with the non-evaporable liquid aliphatic hydroxy compound containing the swelling agent and salts together with the dye or after impregnation of the dye. These fibers or fabrics cannot be dyed at all by, for example, a pad-dry heat treatment.

Thus, according to this invention, aromatic polyamide fibers or fabrics can be dyed in high density and to high light fastness by specifying the dye, the swelling agent and the salts, the amounts of these compounds, and the non-evaporable liquid aliphatic hydroxy compound.

Since according to the process of this invention, aromatic polyamide fibers or fabrics can be dyed in deep colors and without non-uniformity in dyeing by a simple method which involves impregnating these fibers or fabrics with a non-evaporable liquid containing the dye, swelling agent and salts, the commercial significance of this is very great.

The following Examples illustrate the process of this invention and its advantages more specifically.

In the Examples, the measurement of dyeability and light fastness was performed as follows:

Dyeability

This is expressed by the brightness (L value) of dyed goods which has been measured using a color differential meter. This value differs according to the dye used. When the same dye is used, larger L values show brighter dyeings, and smaller values, deeper dyeings.

Light fastness

Measured using a fade-O-meter (JIS L-1044/59, a carbon arc lamp method, A method).

In the Exampls, o.w.s. means the weight percent of each of the ingredients of an impregnating composition to be impregnated in fibers or fabrics based on the total weight of this composition.

EXAMPLE 1

A woven fabric produced from polymetaphenylene isophthalamide terephthalamide fibers was immersed in an ethylene glycol liquid containing 5% o.w.s. of C. I. Basic Orange 22 (C. I. No. 48,040), 2% o.w.s. of acetic acid, 5% o.w.s. sodium nitrate, and 10% o.w.s. of para-phenylphenol at a temperature of 80°C., and squeezed by means of a mangle heated at 80°C. to remove free excessive liquid and to impregnate the composition uniformly in the fabric. At this time, the pick-up of the composition was 80% based on the weight of the fabric before impregnation. The fabric was treateed with steam at 135°C. for 30 minutes, and soaped in a customary manner. The dyeing obtained was of a brilliant and deep color, and no uneveness in dyeing was observed.

The dyeability of this dyeing was expressed by an L value of 45.6 and it had a light fastness of 5.

EXAMPLES 2 TO 4 AND COMPARATIVE EXAMPLES 1 AND 2

Dyeing was performed in the same way as in Example 1 except that the amount of sodium nitrate was varied. The dyeability and light fastness of the dyeings were measured, and the results obtained are shown in Table 1.

Table 1

| Examples | Amount of sodium nitrate (%) | L value | Light fastness |
|---|---|---|---|
| Comparative Example 1 | 0 | 54.1 | 2 |
| Comparative Example 2 | 0.5 | 53.0 | 2 |
| Example 2 | 1.5 | 49.2 | 3 |
| Example 3 | 3 | 46.0 | 4–5 |
| Example 1 | 5 | 45.6 | 5 |
| Example 4 | 10 | 44.8 | 5 |

EXAMPLE 5

An ethylene glycol solution containing 5% o.w.s. of C. I. Basic Blue 54, 2% o.w.s. of acetic acid, 5% o.w.s. of ammonium nitrate, 10% o.w.s. of para-phenyl phenol and 20% o.w.s. of ethanol was placed in a bath of a high pressure jigger dyeing machine, and uniformly dissolved by heating it to 80°C. A woven fabric composed of polymetaphenylene isophthalamide fibers was treated for 10 minutes while passing the fabric back and forth using a jigger mechanism. The moving of the fabric was then stopped, and the treating liquid was discharged while the fabric was in the wound-up state. Steam was introduced into it in a sealed condition. When the temperature of the steam reached 140°C., the movement of the fabric was resumed and it was treated for 30 minutes. The fabric was soaped in a customary manner to form a dyeing of a brilliant and deep color with no unevenness in dyeing. The dyeing had an L value of 19.5, and a light fastness of 4 to 5.

EXAMPLE 6

A woven fabric produced from polymetaphenylene isophthalamide fibers was immersed at room temperature in an aqueous solution containing 5% o.w.s. of C. I. Basic Orange 22 (C. I. No. 48,040), and squeezed by means of a mangle to remove free of excessive liquid and to impregnate the solution uniformly in the woven fabric. The pick-up was 80% of the weight of the fabric before impregnation.

The treated fabric was dried for 1 minute at about 130°C., and then immersed in an ethylene glycol liquid at 80°C. containing 10% o.w.s. of para-phenyl phenol and 5% o.w.s. of sodium nitrate. Then, the treated fabric was squeezed by means of a mangle heated at 80°C. to a pick-up of 80%. The fabric was treated with steam for 30 minutes at 130°C., and soaped in a customary manner. The resulting dyeing was of a deep and brilliant color, and no uneveneness in dyeing was observed. The dyeing had an L value of 45.0 and a light fastness of class 5.

EXAMPLE 7

A woven fabric made of fibers of an aromatic polyamide obtained by polycondensing terephthalic acid and sodium-2,4-diaminobenzenesulfonate was immersed in an ethylene glycol solution at 80°C. containing 5% o.w.s. of C. I. Basic Orange 22 (C. I. No.

48,040), 2% o.w.s. of acetic acid, 5% o.w.s. of sodium nitrate and 10% o.w.s. of para-phenyl phenol, and then squeezed by means of a mangle heated at 80°C. to remove free excessive liquid and to impregnate the liquid uniformly in the fabric. At this time, the pick-up was 70% based on the weight of the fabric before impregnation. The fabric was treated with steam at 135°C. for 30 minutes, and soaped in a customary manner. The resulting dyeing was of a brilliant and deep color, and no unevenness in thickness was observed. The dyeing had an L value of 42.2 and a light fastness of 6.

EXAMPLES 8 TO 11

Dyeing was performed in the same way as in Example 1 except that 10% o.w.s. each of o-phenylphenol, benzophenone, α-naphthol and β-naphthol were used respectively instead of 10% o.w.s. of p-phenylphenol. The resulting dyeing was a brilliant and deep color, and no uneveneness in dyeing was observed. The dyeability (L value) and light fastness of each of the dyeings obtained are shown in Table 2.

Table 2

| Examples | Swelling agent | L value | Light fastness |
|---|---|---|---|
| 8 | o-Phenylphenol (10% o.w.s.) | 46.3 | 4–5 |
| 9 | Benzophenone (10% o.w.s.) | 48.4 | 4–5 |
| 10 | α-Naphthol (10% o.w.s) | 44.4 | 5 |
| 11 | β-Naphthol (10% o.w.s.) | 45.5 | 5 |

EXAMPLES 12 TO 15

Dyeing was performed in the same way as in Example 1 except that the same amounts of potassium nitrate, sodium chloride, potassium chloride and ammonium chloride were used respectively instead of the sodium nitrate. The resulting dyeings were of brilliant and deep colors, and no uneveneness in dyeing was observed. The dyeability (L value) and light fastness of each of the dyeings were measured, and the results are shown in Table 3.

Table 3

| Examples | Salts | L value | Light fastness |
|---|---|---|---|
| 12 | Potassiuum nitrate 5% o.w.s. | 45.2 | 5 |
| 13 | Sodium chloride 5 % o.w.s. | 44.8 | 5 |
| 14 | Potassium chloride 5 % o.w.s. | 44.6 | 5 |
| 15 | Ammonium chloride 5 % o.w.s. | 44.2 | 5 |

EXAMPLES 16

Dyeing was performed in the same way as in Examples 1 except that propylene glycol was used instead of ethylene glycol. The dyeing obtained was of a brilliant and deep color, and no uneveneness in dyeing was observed. The dyeing had an L value of 45.0 and a light fastness of class 5.

COMPARATIVE EXAMPLES 3 AND 4

Dyeing was performed in the same way as in Example 1 except that instead of C. I. Basic Orange 22, an acid dye (C. I. No. 15,510) and a disperse dye (C. I. No. 26,080) of the same color were used respectively. Where the disperse dye was used, sodium nitrate was not used. The dyeability (L value) and light fastness of the dyeings are shown in Table 4 below.

COMPARATIVE EXAMPLES 5 TO 7

Dyeing was performed in the same way as in Example 1 except that p-phenylphenol, sodiun nitrate and both of them were not used respectively. The dyeability (L value) and light fastness of the dyeings obtained were measured, and the results are shown in Table 4.

COMPARATIVE EXAMPLE 8

Dyeing was performed in the same way as in Example 1 except that the fabric impregnated with the dye liquor was treated in dry heat at 200°C. for 3 minutes instead of being treated with steam at 135°C. for 30 minutes. The dyeability (L value) and light fastness of the dyeing obtained were measured, and the results are shown in Table 4.

COMPARATIVE EXAMPLE 9

The same woven fabric as used in Example 1 was immersed in the same bath as used in Example 1 with the goods-to-liquor ratio maintained at 1 : 50, and dip-dyeing was performed for 30 minutes at 100°C. The dyeability (L value) and light fastness of the resulting dyeing were measured, and the results are shown in Table 4 below.

COMPARATIVE EXAMPLE 10

The same woven fabric as used in Example 1 was immersed in 100% ethylene glycol with the goods-to-liquor ratio maintained at 1 : 50, and treated at 100°C. for 30 minutes. The fabric was withdrawn from the bath, and washed with water. The woven fabric so pre-treated with ethylene glycol was dyed in the same way as in Example 1 using the same dye bath as in Example 1 except that water was used instead of the ethylene glycol. The dyeability (L value) and light fastness of the resulting dyeing were measured, and the results are shown in Table 4.

For comparison, Table 4 also show the L value and light fastness of the dyeing obtained in Example 1.

Table 4

| | Dyes | Swelling agent (p-phenyl-phenol) | Salt ($NaNO_3$) | Treating conditions | L value | Light fastness |
|---|---|---|---|---|---|---|
| Example 1 | Cationic dye (C.I. 48070) | 10% | 5% | 135°C., 30 minutes steam | 45.6 | 5 |
| Comparative Example 3 | Acid dye (C.I. 15510) | 10% | 5% | 135°C., 30 minutes steam | 52.1 | 2 |
| Comparative Example 4 | Acid dye (C.I. 26080) | 10% | — | 135°C., 30 minutes steam | Discolored | — |
| Comparative Example 5 | Cationic dye (C.I. 48040) | — | 5% | 135°C., 30 minutes steam | 50.4 | 3 |

Table 4-continued

| | Dyes | Swelling agent (p-phenyl-phenol) | Salt ($NaNO_3$) | Treating conditions | L value | Light fastness |
|---|---|---|---|---|---|---|
| Comparative Example 6 | Cationic dye (C.I. 48040) | 10% | — | 135°C., 30 minutes steam | 54.1 | 2 |
| Comparative Example 7 | Cationic dye (C.I. 48040). | — | — | 135°C., 30 minutes steam | 56.6 | 1 |
| Comparative Example 8 | Cationic dye C.I. 48040) | 10% | 5% | 200°C., 30 minutes dry heat | 48.5 | 1 |
| Comparative Example 9 | Cationic dye (C.I. 48040) | 10% | 5% | 100°C., 30 minutes dip-dyeing | 60.3 | 1 |
| Comparative Example 10 | Cationic dye (C.I. 48040) | 10% | 5; | Pretreated with ethylene glycol, aqueous dye bath | Unevenness in dyeing | — |

What we claim is:

1. A process for dyeing aromatic polyamide fibers or fabrics, which comprises impregnating aromatic polyamide fibers or fabrics with (a) a cationic dye, (b) an aliphatic hydroxy compound having a boiling point of at least 180°C., (c) at least one swelling agent selected from the group consisting of o-phenylphenol, p-phenylphenol, benzophenone, $\beta$-naphthol and $\alpha$-naphthol and (d) at least one of alkali metal salts or ammonium salts of inorganic or organic acids, the amount of said salt (d) being 1 to 10% by weight based on the sum total of the amounts of the dye (a), the hydroxy compound (b), the swelling agent (c) and the salt (d); and then heat-treating said fibers or fabrics with steam.

2. The process of claim 1 wherein said salt (d) is sodium nitrate, potassium nitrate, ammonium nitrate, sodium chloride, potassium chloride or ammonium chloride.

3. The process of claim 1 wherein the amount of said salt (d) is 3 to 10% by weight of the sum total of the amounts of the dye, aliphatic hydroxy compound, swelling agent and salt.

4. The process of claim 1 wherein the amount of said swelling agent (c) is 5 to 50% by weight based on the sum total of the amounts of the dye (a), aliphatic hydroxy compound (b), swelling agent (c) and salt (d).

5. The process of claim 1 wherein the amount of the swelling agent (c) is 5 to 15% by weight based on the sum total of the amounts of the dye (a), aliphatic hydroxy compound (b), swelling agent (c) and salt (d).

6. The process of claim 1 wherein said aromatic polyamide fibers or fabrics are impregnated with a mixture consisting essentially of the cationic dye, the swelling agent, the salt and the aliphatic hydroxy compound.

7. The process of claim 1 wherein said aromatic polyamide fibers or fabrics are impregnated with an aqueous solution of the dye, dried, and then impregnated with a mixture consisting essentially of the swelling agent, the salt and the aliphatic hydroxy compound.

8. The process of claim 1 wherein said aliphatic hydroxy compound (b) is ethylene glycol or propylene glycol.

* * * * *